US005221070A

United States Patent [19]

Heilmer

[11] Patent Number: 5,221,070

[45] Date of Patent: Jun. 22, 1993

[54] ADJUSTABLE BOOK HOLDER

[76] Inventor: Arthur W. Heilmer, 8206 Washburn Ave. South, Bloomington, Minn. 55431

[21] Appl. No.: 681,157

[22] Filed: Apr. 5, 1991

[51] Int. Cl.[5] ..... A47B 23/00

[52] U.S. Cl. ..... 248/447.1; 248/454; 248/458

[58] Field of Search ..... 248/454, 460, 297.3, 248/296, 457, 446, 447, 447.1, 458

[56] References Cited

U.S. PATENT DOCUMENTS

| | | | |
|---|---|---|---|
| 368,388 | 8/1887 | Drake | 248/460 |
| 533,619 | 2/1895 | Stuebing | 248/296 |
| 646,835 | 7/1906 | Jackson | 248/454 X |
| 766,890 | 8/1904 | Newberg | 411/433 X |
| 1,037,140 | 8/1912 | French | 248/457 |
| 2,747,322 | 5/1956 | Eggher | 248/454 |
| 4,503,981 | 3/1985 | Coronado | 248/454 X |
| 4,754,945 | 7/1988 | Diamond | 248/460 |

FOREIGN PATENT DOCUMENTS

| | | | |
|---|---|---|---|
| 164264 | 6/1921 | United Kingdom | 248/458 |

*Primary Examiner*—Alvin C. Chin-Shue
*Attorney, Agent, or Firm*—John P. Halvonik

[57] ABSTRACT

The invention relates to an adjustable support arm and assembly at the side of a chair, capable of holding a book in position for reading. The apparatus uses a free standing cabinet at the side of the chair as a support structure for the rest of the system. A book holding assembly is in connection with an upright shaft having annular grooves that rotates and moves vertically within the central channel of a support block that is attached to the framework. A spring biased latch plate secures the shaft at a vertical position by engaging with one of the annular grooves of the shaft. The support block moves horizontally along a rail connected to the framework. Rotational and pivoting movements are also possible to allow a wide variety of book positions.

2 Claims, 3 Drawing Sheets

ADJUSTABLE BOOK HOLDER

BACKGROUND OF THE INVENTION

1. Field of the Invention

This invention relate to the field of book support arms that are used in connection with chairs to provide a means of holding a book for a reader in a chair. The holder of the present invention can move in the vertical and horizontal dimension, and pivot in various directions to make for an ideal reading angle.

2. Prior Art

While book holders are known, none that applicant is aware of are of the same construction. Moreover, none of the prior art devices are capable of the range of movement of applicants, viz.: rotational, horizontal, upright and pivoting. Positions along these dimensions may be set at various levels by the user.

SUMMARY OF THE INVENTION

The book holder is supported by a cabinet that is next to a chair and supports a book in a position ideal for the user to read while sitting in the chair. The holder has an upright support member (vertical support member) to set the vertical shaft at various levels vis a vis the support block which remains in a fixed vertical position. At the top of the vertical shaft is the arm elbow which acts as a pivoting means for the book support arm. The pivoting means has a channel to support the arm and can pivot up or down and rotate with the support member at the axis of rotation so that the support arm can be moved away from the reader in the chair. The book support arm can extend horizontally from the arm elbow and also rotate away from or toward the reader so that the shaft can be placed at a level ideal for the reader.

It is an object of the invention to provide a book supporting member that can be adjusted to various vertical and horizontal positions and can be angled to various degrees to provide an ideal reading position for a reader.

Other advantages of the invention will become apparent to those skilled in the art once the invention is shown and described.

Figure 1:
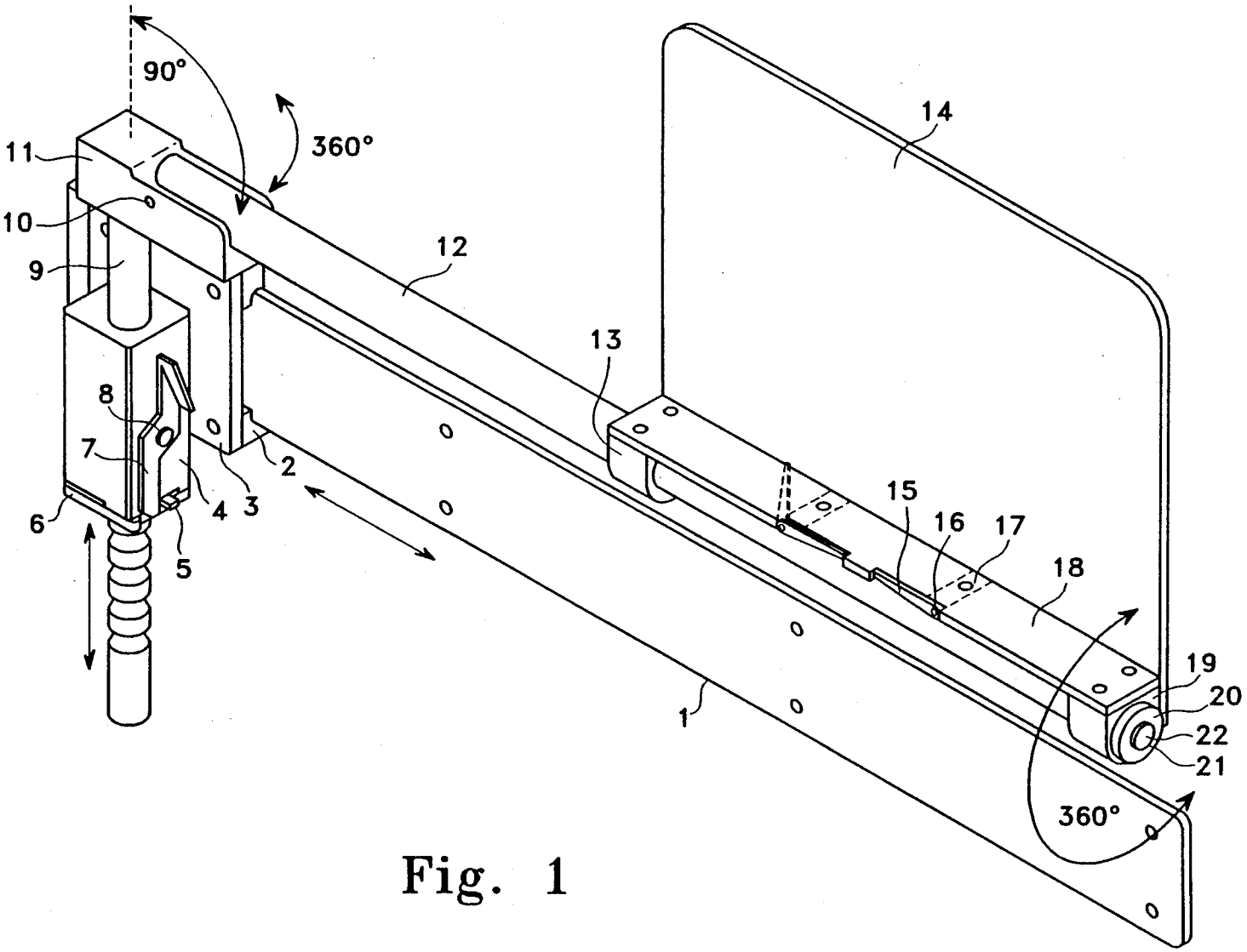
FIG. 1 shows the overall construction of the book holder.
Figure 2A:
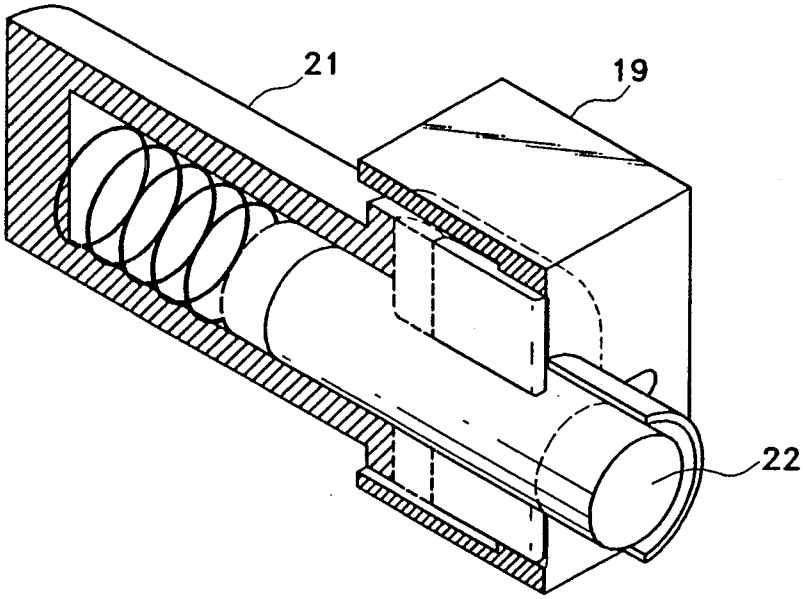
FIG. 2A shows cross section of stator plug assembly.
Figure 2:
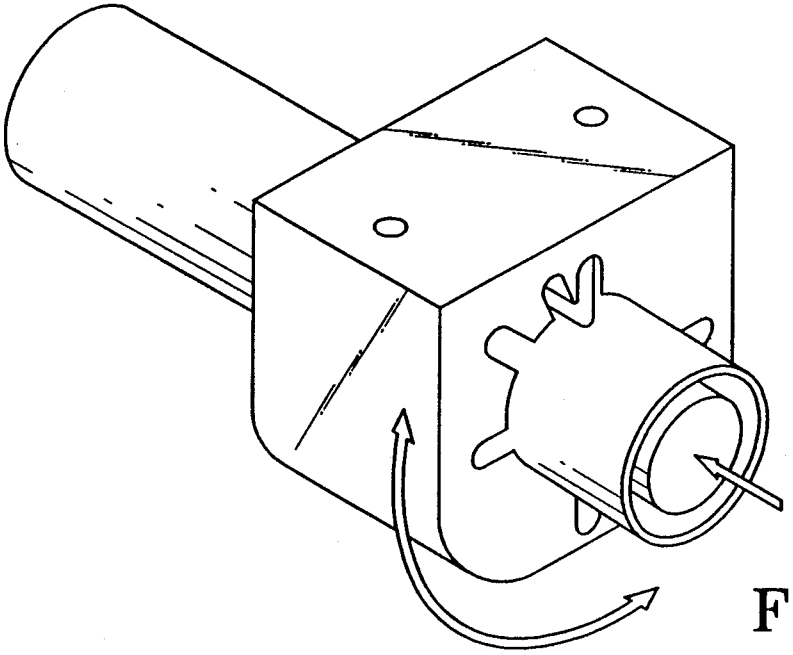
FIG. 2 shows stator plug assembly.
Figure 3:
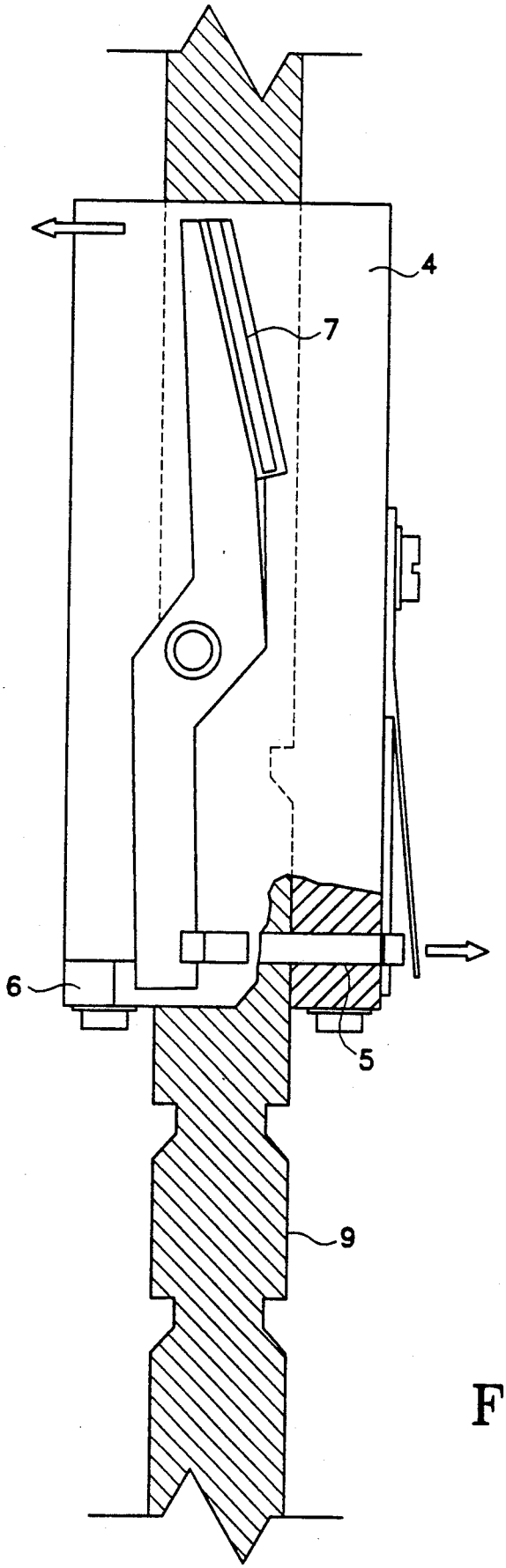
FIG. 3 shows the vertical shaft mechanism.

Sheets 4–15.

DESCRIPTION OF THE INVENTION

The book holder is mounted within a free standing cabinet that provides a support structure for the carriage plate 3, support block 4, and the rest of the assembly. The support rail 1 is installed vertically and is oriented horizontally along the inside of the cabinet from back to front. The rail may be of aluminum and secured by a number of mounting screws and spacers. The spacer provide necessary clearance between the mounting surface and the rail so that the carriage plate (and the attached support block) may move freely along it.

On this rail slides a carriage plate 3 supported and guided by two bearing blocks 2 which are secured to the plate by screws. The bearing blocks have grooves cut lengthwise which engage the top and bottom edge of the rail. This allows the support block and the vertical shaft which supports the book holder to be positioned alongside the reader and then be moved closer or farther away from him/her by the movement of the carriage plate along the support rail.

Mounted to the carriage plate 3 is the support block 4 which is a block shaped structure having a vertical central channel through which the vertical shaft 9 slides. The vertical shaft has a series of annular grooves. The support block has a spring biased latch plate 5 which is in close proximity to the vertical shaft and can engage the annular grooves so the vertical shaft can be set at various levels and thus allow the reader to move the book holder up or down in relation to him.

The latch plate slides in a groove on the bottom of the support block and is retained by the support block cap 6 and its four screws. The support block may be of any shape, a block is preferred and the number of retaining screws used may, of course, vary.

The latch lever 7 is located at one side of the support block and pivots on a screw 8. The movement of the lever contacts the latch plate and slides the latch plate out of engagement with the vertical shaft's annular grooves. Thus allowing vertical adjustment by the movement of the vertical shaft within the central channel of the support block. A spring returns the latch plate to the latched position when the latch lever is released.

Securely fastened on the top end of the vertical shaft is the arm elbow (or pivoting means) 11. In the arm elbow is a half round groove that the arm tube 12 nests in. The arm tube is secured in the groove by the pivot pin 10 which allows the tube to pivot at an angle to the elbow. Rotational movement of the arm elbow is achieved through the rotation of the elbow and the vertical shaft within the confines of the channel. The grooves in the support shaft allow the shaft to turn against the latch plate that remains in place throughout rotation. Thus the arm elbow (and attached book holder assembly) can be swung away from or toward the reader.

The groove in the arm elbow gives lateral stability to the arm tube, and also provides downward support. The pivot pin allows the arm tube to swing upward in order to store the book holder easily into the cabinet. On the bottom and at the open end of the arm elbow groove is a trim screw for adjusting the horizontal attitude of the arm tube.

The book holder assembly itself consists of the inner support bracket 13 and the outer support bracket 19 to which is fastened by screws the back support 14 and the shelf 18. The inner and outer support brackets have bearing holes to allow 360 degrees travel around the arm tube. In the outer end of the arm tube and securely fastened to it is the stator plug 21. The stator plug acts as an anchor component for the latch mechanism, located inside the outer support bracket. Pressing the push button 22 located in the center of the stator plug releases the book holder assembly from the stator plug. This allows adjustment of the book angle to a series of predetermined positions by changing the angle of the back support either toward or away from the reader. The retainer ring 20 provides end thrust and holds the book holder assembly on to the arm tube.

There are two support gussets 17 for the shelf, which also serve to mount the two anti close levers 15. They pivot 90 degrees to a vertical position on screw 16 as needed to keep the book from closing. When not needed, the levers rest horizontally in notches in the front edge of the shelf.

I claim:

1. A book holding apparatus for connection alongside chairs for holding books at reading levels for one sitting in said chair said apparatus comprising: support framework alongside said chair, support rail secured to said framework in a horizontal position alongside said chair, carriage plate slidably connected to said rail for horizontal movement along said support rail, support block in connection with said plate and having a central channel oriented in a direction perpendicular to said support rail, vertical support post having annular grooves and positioned inside said channel for vertical movement within said channel, contacting means in connection with said support block, said contacting means for engaging and disengaging with said annular grooves so that said vertical post may be set at various horizontal intervals corresponding to said grooves, a support arm pivotally connected to said vertical post at one end and having a book support bracket fixed for rotation about said support arm at the other end, said support arm having a spring biased latch means for engaging said support bracket to prevent rotation, said latch means for allowing said support bracket to rotate upon being depressed.

2. The apparatus of claim 1 wherein said vertical post is fixed for rotational movement within said central channel.

* * * * *